US006470815B1

(12) United States Patent
Ho

(10) Patent No.: US 6,470,815 B1
(45) Date of Patent: Oct. 29, 2002

(54) STRUCTURE HIGH SPEED ZIGZAG STITCH INDUSTRIAL-USE SEWING MACHINE

(76) Inventor: Tsai-Fa Ho, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/834,636

(22) Filed: Apr. 16, 2001

(51) Int. Cl.[7] ..... D05B 3/02
(52) U.S. Cl. ..... 112/459; 112/260
(58) Field of Search ..... 112/459, 463, 112/465, 466, 157, 443, 448, 220, 221, 260, 47; 12/4.1, 13.2

(56) References Cited

U.S. PATENT DOCUMENTS 1,116,679 A * 10/1914 Dashew ..... 112/459
3,799,083 A * 3/1974 Karcher, Jr. et al. ..... 112/47
4,520,744 A * 6/1985 Portilla ..... 112/260

* cited by examiner

*Primary Examiner*—Peter Nerbun
(74) *Attorney, Agent, or Firm*—Troxell Law Office PLLC

(57) ABSTRACT

An improved structure high speed zigzag stitch industrial-use sewing machine in which a vertically extending columnar elevated material feed needle plate platform (Post Bed) structure is disposed below the needle holder of the sewing machine. The drive mechanism of the revolving shuttle and the material feed dog plate are situated in the interior section of the elevated material feed needle plate platform, with changes in the type of stitches sewn by the sewing machine governed by a pattern cam. As such, the elevated material feed needle plate platform (Post Bed) structure provides for wider applications than conventional level platform-type material feed needle plates which are incapable of easily sewing across concave, convex, and other irregular contours of objects being processed. The present invention is not only capable of various types of zigzag stitching, but also provides for the sturdier sewing and a more attractive appearance of finished objects, while increasing the value, product quality and productivity of sewing machines in this category of industrial equipment.

3 Claims, 9 Drawing Sheets

STRUCTURE HIGH SPEED ZIGZAG STITCH INDUSTRIAL-USE SEWING MACHINE

BACKGROUND OF THE INVENTION

1. Field of the Invention

The invention herein relates to an improved structure high speed zigzag stitch industrial-use sewing machine in which a vertically extending, mailbox-shaped elevated material feed needle plate platform (Post Bed) structure is disposed below the needle holder of the sewing machine and, furthermore, the drive mechanism of the revolving shuttle and the material feed dog plate are situated in the interior section of the elevated material feed needle plate platform (Post Bed), with modifications afforded by the said drive mechanism enabling a size reduction of the interior section of the columnar elevated material feed needle plate platform (Post Bed) and variations in the type of stitches sewn by the sewing machine are governed by a pattern cam; the said mailbox-shaped elevated material feed needle plate platform (Post Bed) structure especially provides for wider applications than conventional level platform-type material feed needle plates which are incapable of easily sewing across concave, convex, and other irregular contours of objects being processed; as such, the present invention is not only capable of various types of zigzag stitching, but also provides for the sturdier sewing and more attractive appearance of finished objects, while increasing the value and product quality and productivity of sewing machines in this category of industrial equipment.

2. Description of the Prior Art

Referring to FIG. 7, a conventional level platform-type sewing machine structure, the sewing machine B has disposed at its bottom section (below the needle holder B6) a level platform-type material feed needle plate base B7 structure and, as indicated in FIG. 1 and FIG. 2, a dog base plate B71 is situated at the interior section of the material feed needle plate base B7 which facilitates the installation of a material feed dog B72 at the top section of the dog base plate B71, and since one end of the dog base plate B71 is conjoined to an eccentric shaft B11 at the tail end of another drive shaft B1' of the bottom panel and the other end is conjoined to a rocker arm B74, when the drive shaft B1' is driven by the belt C and rotates along with the drive shaft B1, this initiates the movement of the dog base plate B71 following the repeated path shown in FIG. 3 and, furthermore, there is a press foot B75 at the upper extent of the material feed needle plate base B7 and when the dog base plate B71 ascends, the material feed dog B72 and the press foot B75 grasp the object being processed D between them such that the object being processed D becomes taut, at which time the dog 72 moves forward and backward (in the direction of the operator) along with the dog base plate B71 and after the object being processed D is pulled a given distance, the dog base plate B71 descends and releases the object being processed D, and then the dog base plate B71 moves forward and backward to the other side such that when the dog base plate B71 ascends once again and contacts the object being processed, the repetitive said routine completes the sewing action of the needle holder B6; furthermore, a pattern cam A structure is situated inside the head of the sewing machine B and the pattern cam A is coupled to a transverse main shaft B1 and rotates along with a main shaft B1; an idler wheel fixture B3 rests against the pattern cam A and is linked to a needle holder fixture B5 via a connecting rod B4 such that when the main shaft B1 of the sewing machine B drives the needle holder B6 upward and downward, the pattern cam A is thus rotated by the transverse shaft B2 which causes the idler wheel fixture B3 to move following the sinusoidal surface of the pattern cam A and the connecting rod B4 to repeatedly swing the needle holder fixture B5 leftward and rightward, while the needle holder B6 of the sewing machine B moves upward and downward to sew the object being processed to collectively generate a left and right transverse movement and thereby effectively accomplish a variable zigzag stitch as the object being processed is conveyed forward.

In addition, a revolving shuttle B8 structure is disposed within the interior section of the material feed needle plate base B7, the revolving shuttle B8 consisting of a connected drive mechanism that is driven into rotation by the drive shaft B1' such that as the needle holder B6 descends, the thread at the inner section of the revolving shuttle B8 and in the needle B61 at the bottom end of the needle holder B6 is manipulated in a stitching routine that achieves the sewing of the object being processed D; furthermore, since the pattern cam A varying the sewn stitching is situated inside the material feed needle plate base B7 of the said conventional sewing machine, the drive mechanism within the interior section is occupies a space of considerably large dimensions and, furthermore, the other drive shaft B1' rotating along with it in the bottom panel can only be accommodated in a level platform-type design arrangement; however, with regard to the physical characteristic of the object being processed, the level platform-type material feed needle plate base has no positions for a completely flat posturing and cannot be utilized for sewing and finishing irregularly contoured items such as joint guards, footwear, and other convex or concave planes and, therefore, is not only incapable of maintaining product quality, but leads to decreased productivity as well as product quality.

Therefore, the improved structure high speed zigzag stitch industrial-use sewing machine of the invention herein features a vertically extending, columnar elevated material feed needle plate platform (Post Bed) structure disposed below the needle holder of the sewing machine and, furthermore, the drive mechanism of the revolving shuttle and the material feed dog plate are situated in the interior section of the elevated material feed needle plate platform (Post Bed), with variations in the type of stitches executed by the sewing machine governed by a pattern cam; the elevated material feed needle plate platform (Post Bed) structure especially provides for wider applications than conventional level platform-type material feed needle plates which are incapable of easily sewing across the concave, convex, and other irregular contours of objects being processed; if such a columnar elevated needle plate platform is utilized, not only would the embellishing of concave, convex, and other irregular contours be possible, but the various types of zigzag stitching afforded would also provide for the sturdier sewing and a more attractive appearance of finished objects, while increasing the value and product quality and productivity of sewing machines in this category of industrial equipment, and this is the primary objective of the invention herein.

Another objective of the improved structure high speed zigzag stitch industrial-use sewing machine invention herein is the inclusion of a vertical base plate extending upward from the top section of a dog base plate and, furthermore, a vertically oriented slot is formed in the center section of the vertical base plate and a horizontally oriented slot is formed in bottom section of the vertical base plate, with a sliding block respectively situated in the each of the vertically oriented and horizontally oriented slots, such that the vertical base plate is capable of sliding upward and downward as well as swing forward and backward following the articulation of the sliding blocks and slots; thus, when the dog base plate moves, the vertical base plate moves along with it synchronously, thereby enabling the material feed dog at the top section to complete a zigzag stitch as the material is being fed through; and the material feed structure of the original level platform-type material feed needle plate base can be extended into the interior section of the mailbox-shaped, elevated material feed needle plate platform embodiment of the present invention.

Yet another objective of the improved structure high speed zigzag stitch industrial-use sewing machine invention herein is the inclusion of a vertical drive shaft linked to a drive mechanism of the bottom panel that transports the revolving shuttle close to the lower position of the columnar elevated material feed needle plate platform (Post Bed) and, furthermore, in synchronization with a rotating lower drive shaft such that the revolving shuttle structure of the original level platform-type material feed needle plate base can be extended into the interior section of the mailbox-shaped, elevated material feed needle plate platform (Post Bed) embodiment of the present invention.

Still another objective of the improved structure high speed zigzag stitch industrial-use sewing machine invention herein is the inclusion of a skirt plate seating recess formed in the end surface of a pattern mounting base where the pattern cam is sleeved onto a transverse shaft for the placement of a skirt plate into the said skirt plate seating recess and, furthermore, screws are utilized to fasten the skirt plate; in addition, the skirt plate is assembled to a sighting block that is first mounted on the said transverse shaft and when the sewing machine is being assembled and set up, after the calibration of the pattern cam and an eccentric idler wheel is completed as well as the alignment of a locating pin and a locating hole between the sighting block and the skirt plate, this provides for the rapid configuring of the pattern cam as well as the rapid and accurate sleeving of the pattern cam onto the transverse shaft which enables convenient pattern cam replacement and, furthermore, reduces the technical requirements of the operating personnel.

DETAILED DESCRIPTION OF THE INVENTION

Figure 1:
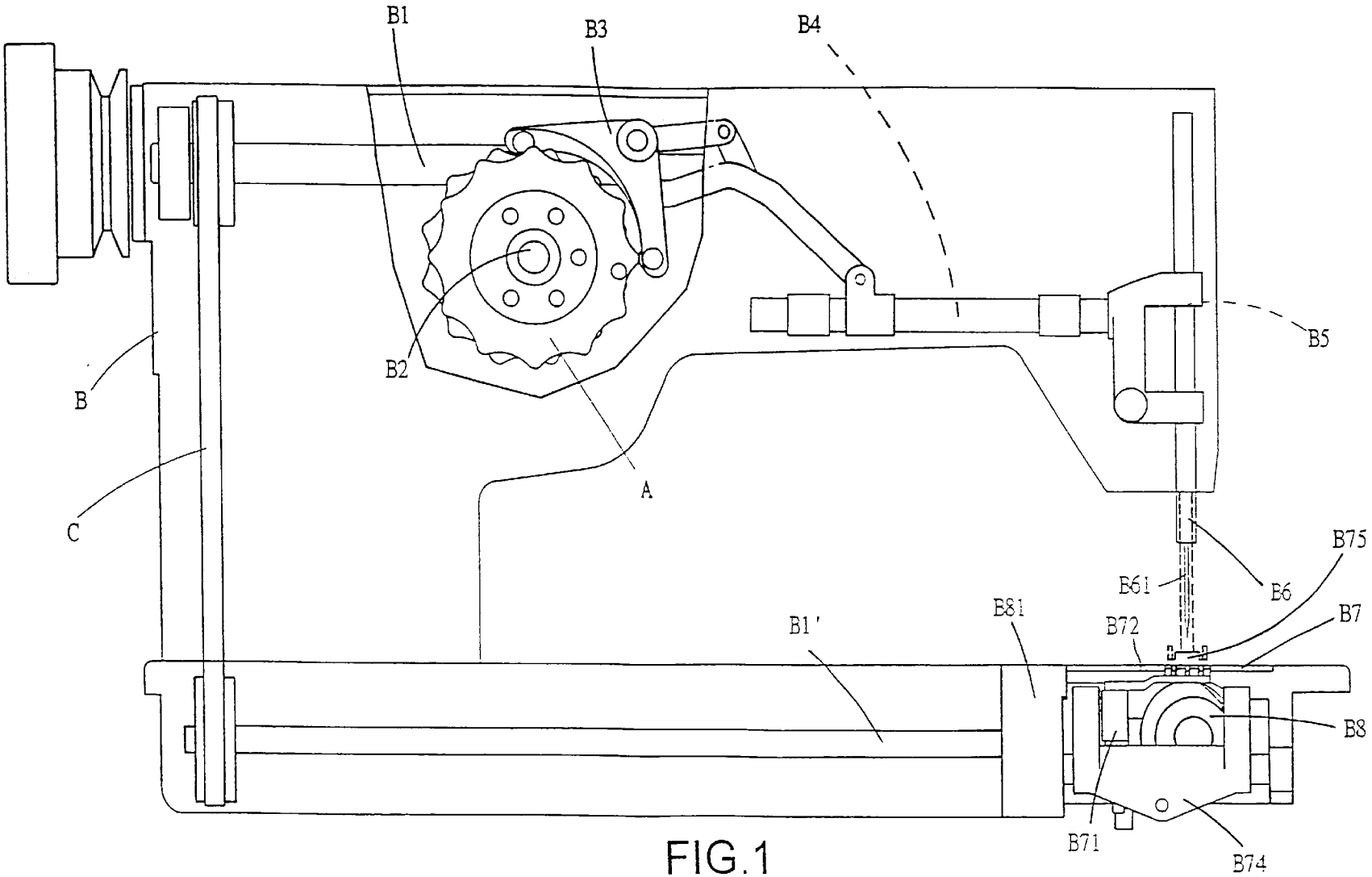
FIG.1 Prior Art
FIG. 1 is an orthographic drawing of a pattern cam structure of a conventional sewing machine as viewed from the rear lateral surface.
Figure 2:
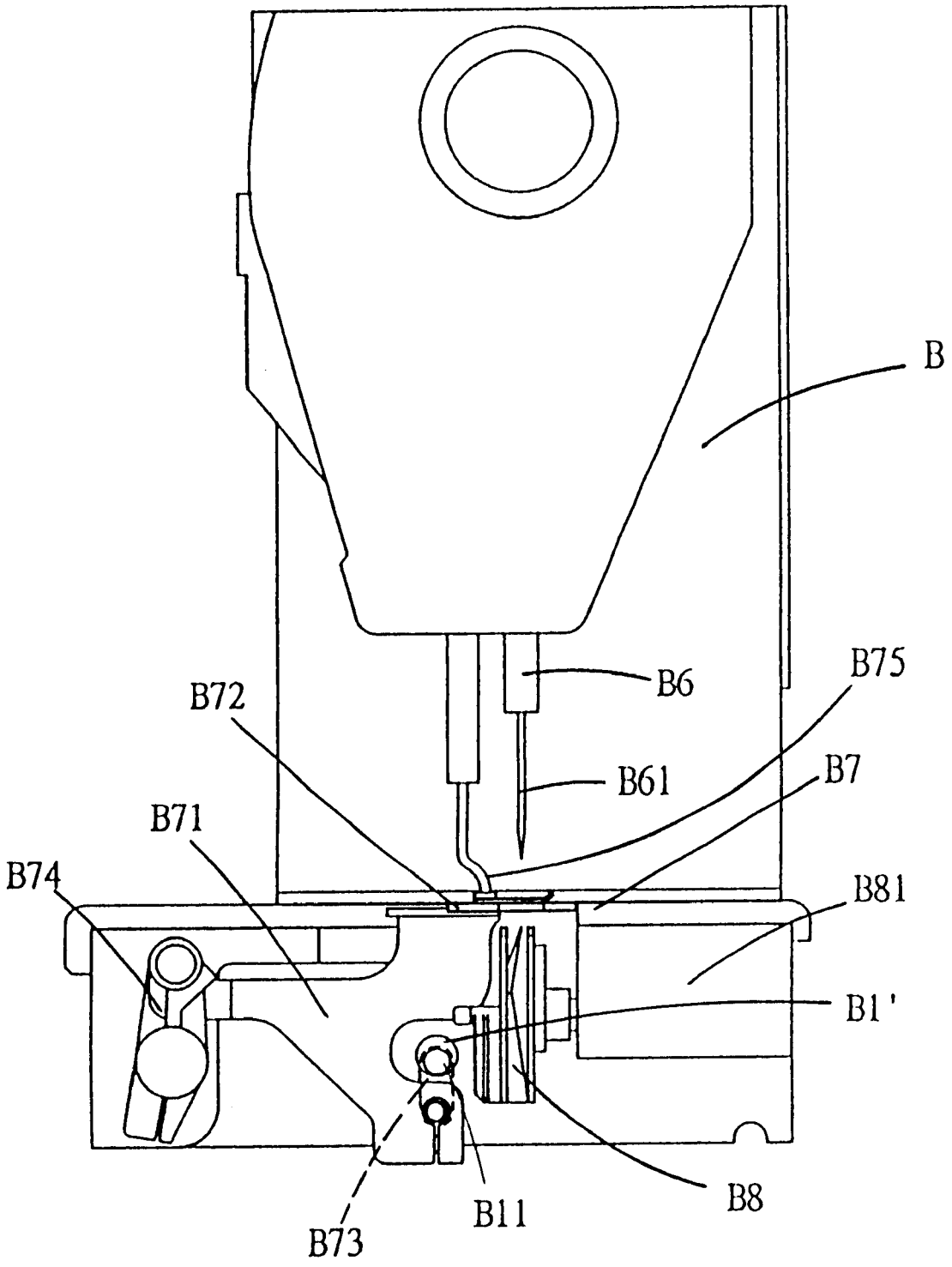
FIG. 2 is an orthographic drawing of FIG. 1 as viewed from the perspective of the operator at the left lateral surface.
Figure 3:
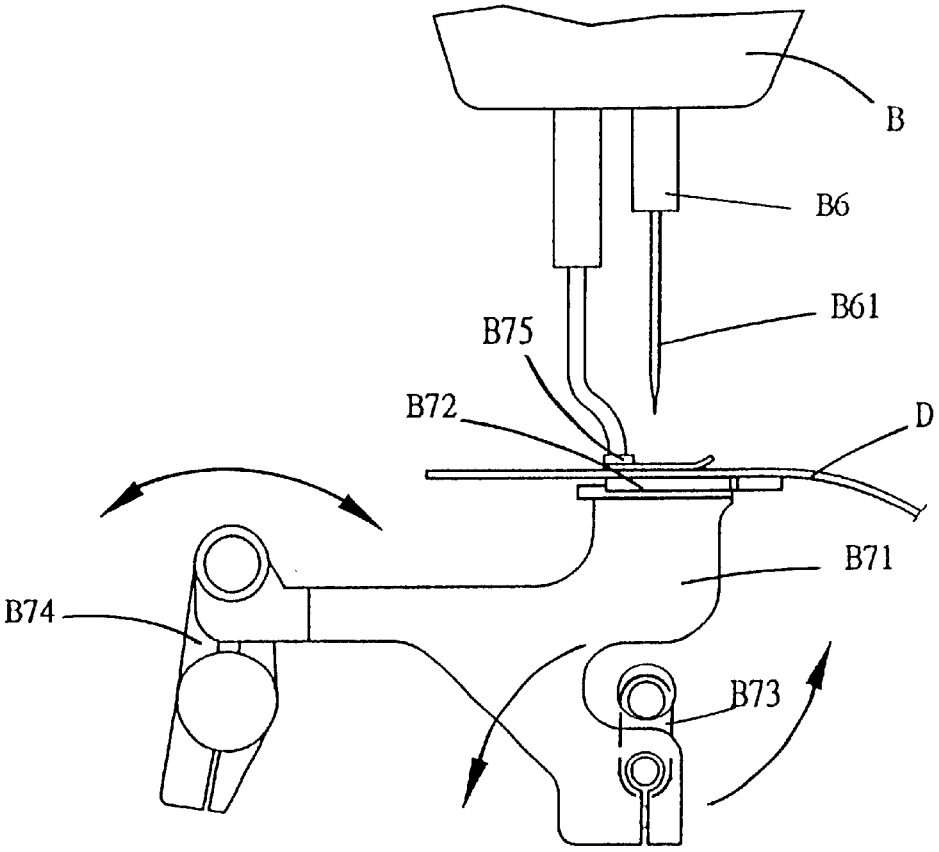
FIG.3 (A) Prior Art
FIG. 3(A) is an orthographic drawing of the dog base plate and the revolving shuttle inside a conventional level platform-type material feed needle plate base.
FIG. 3(B) is an orthographic drawing of the dog base plate operation path inside a conventional level platform-type material feed needle plate base.
Figure 3:
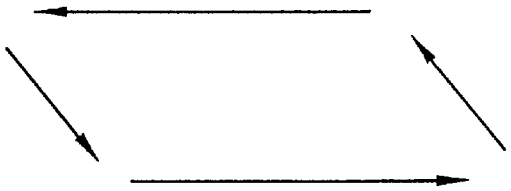
FIG.3 (B) Prior Art
Figure 4:
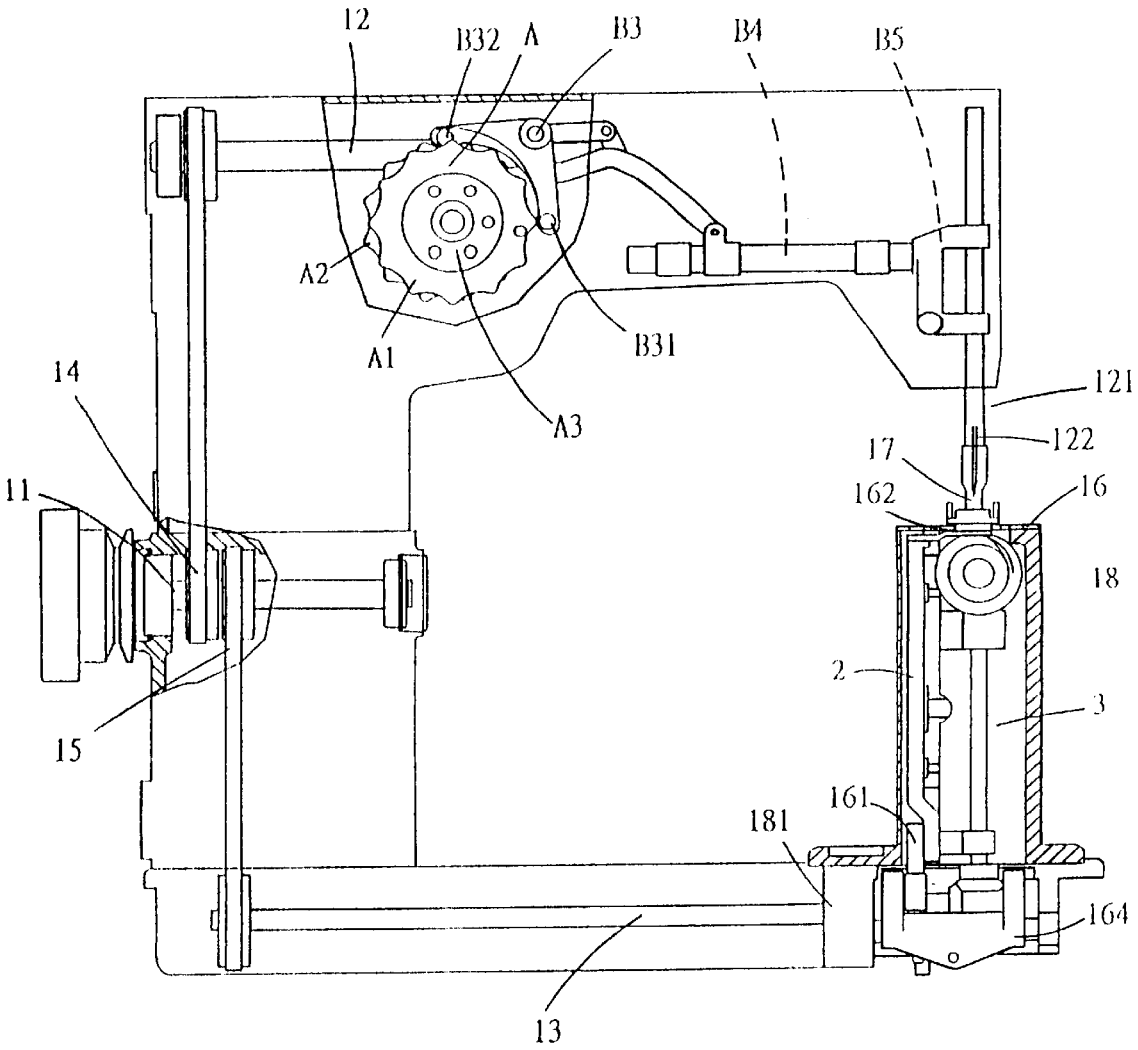
FIG. 4 is a cross-sectional drawing of the mailbox-shaped, elevated material feed needle plate platform high speed zigzag stitch industrial-use sewing machine of the invention herein as viewed from a rear perspective.
Figure 5:
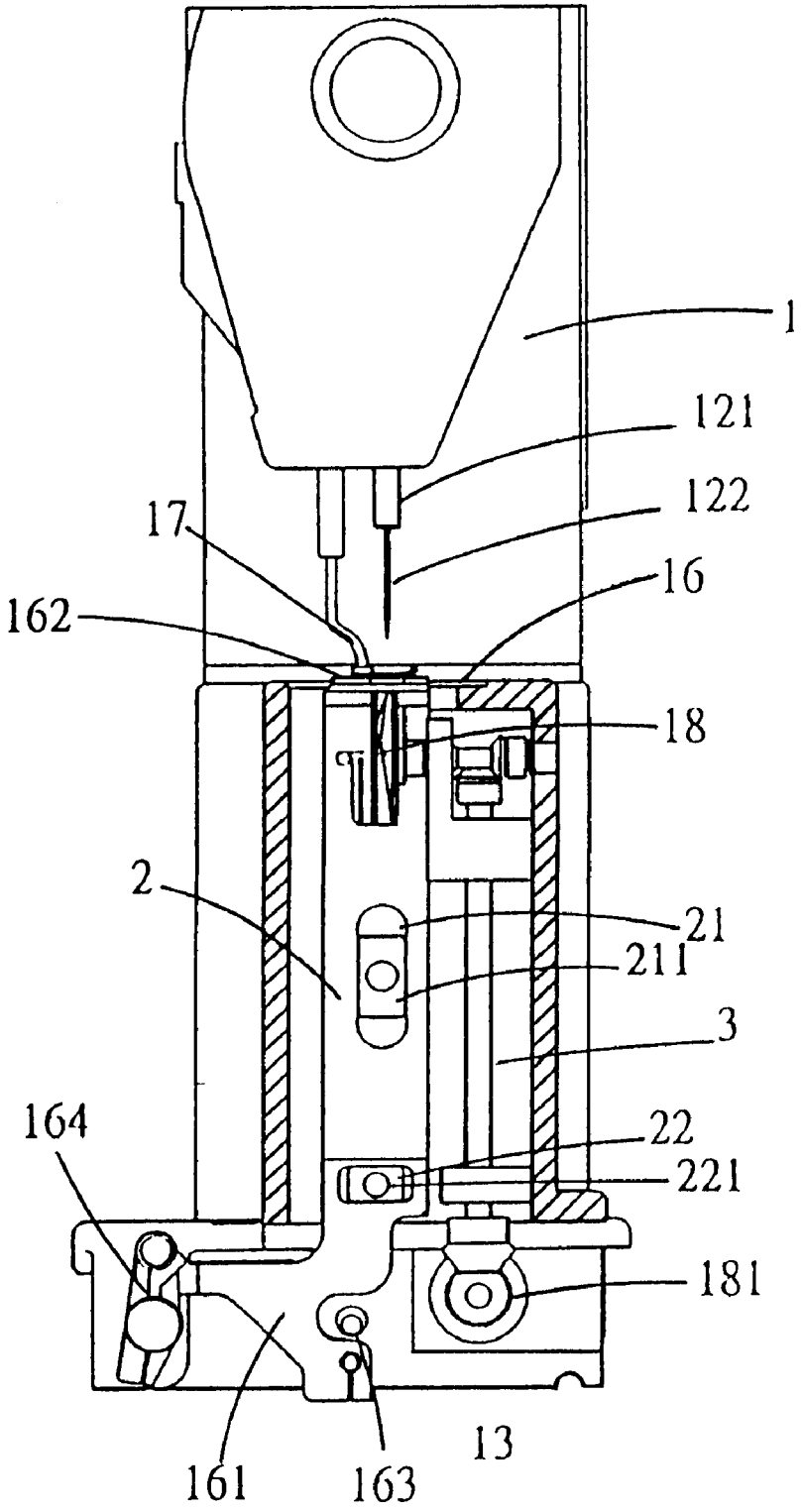
FIG. 5 is a cross-sectional drawing of the sewing machine of the invention herein as viewed from the left lateral surface.

In the improved structure high speed industrial-use zigzag stitch sewing machine of the invention herein, the basic structure of the sewing machine 1, as indicated in FIG. 4 and FIG. 5, consists of a pattern cam A situated inside the head section of the sewing machine 1 that causes a leftward and rightward transverse motion of the needle holder 121 and the production of a zigzag stitch as an object being processed is conveyed forward; of which, the pattern cam A consists of two pattern plate elements A1 and A2 in a stacked arrangement having a series of lobes and troughs proceeding curvilinearly along their circumferences, with a pattern mounting base A3 at their center areas to facilitate the insertion fastening of the pattern cam A structure to a transverse shaft, and in between the transverse shaft and an upper drive shaft 12 of the sewing machine 1 is a worm shaft and worm gear, a drive mechanism that rotates the upper drive shaft 12 such that the transverse rod is brought into motion by the upper drive shaft 12 and thereby rotates the pattern cam A; furthermore, a forked idler wheel fixture B3 is situated on the edge of the pattern cam A, and an eccentric idler wheel B31 and an additional idler wheel B32 on the two prongs of the idler wheel fixture B3 rest against the two pattern plate elements A1 and A2, respectively; furthermore, a connecting rod B4 at one end of the idler wheel fixture B3 is linked to a needle holding fixture B5 such that when the upper drive shaft 12 of the sewing machine 1 is rotating and causes the needle B6 to move upward and downward, the pattern cam A is brought into rotation by the transverse shaft and as the action of the idler wheel fixture B3 is determined by it following the sinusoidal surface of the pattern cam A, the needle holding fixture B5 begins to move in reciprocating transverse manner and, as a result, while the needle B6 of the sewing machine B is travelling up and down during the stitching of an object being processed, it is also moving transversely in alternating directions, thereby effectively producing a zigzag stitch as the object being processed is conveyed straight ahead; since zigzag stitching can provides for increased overall sewn strength in objects being processed, such as premium apparel embellishments or fine item securing, which is especially applicable in the utilization of conventional thread in the production of commercial items in that seams do not have to overlaid and, therefore, traces of sewing are not apparent.

Figure 8:
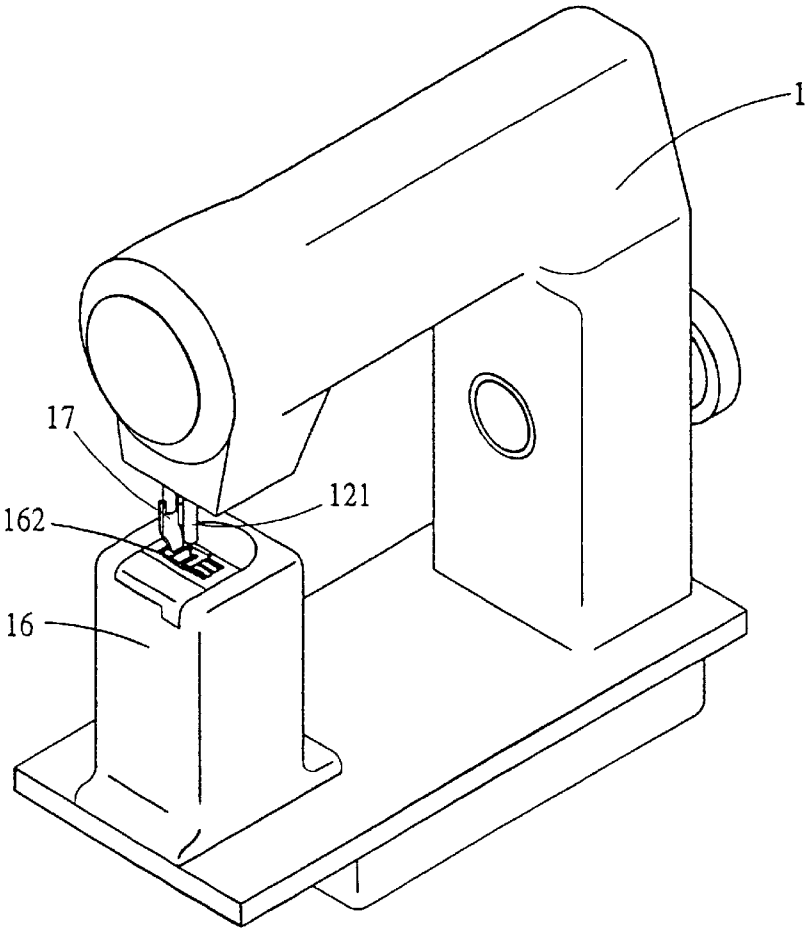
FIG. 8 is an isometric drawing of the mailbox-shaped, elevated material feed needle plate platform (Post Bed) high speed zigzag stitch industrial-use sewing machine of the invention herein.
Figure 7:
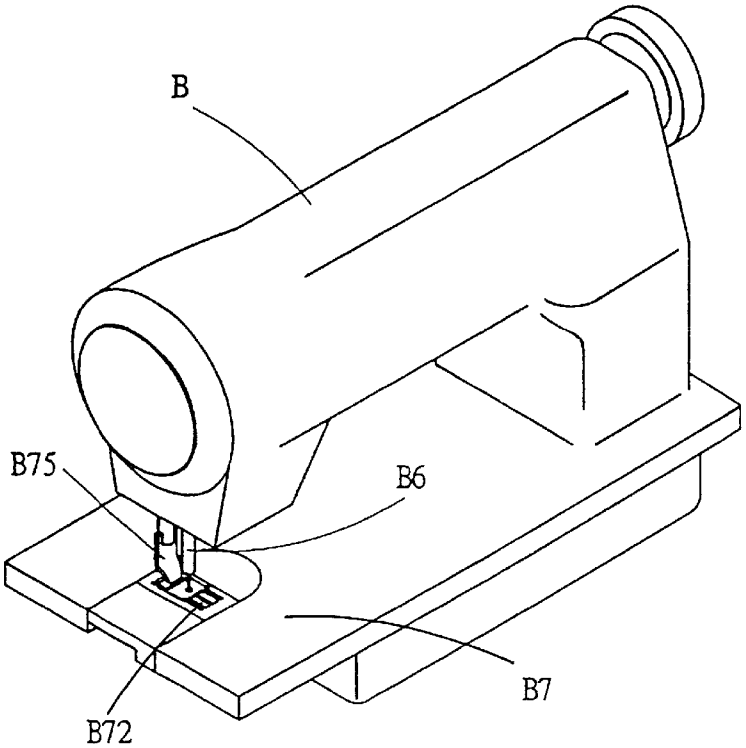
FIG.7 Prior Art
FIG. 7 is an isometric drawing of a conventional sewing machine quipped with a level platform-type material feed needle plate base.

Similarly, at the bottom section (below the needle holder 121) of the sewing machine 1 is a material feed needle plate platform 16 structure and situated in the interior section of the material feed needle plate platform 16 is a dog base plate 161 which facilitates the installation of a material feed dog 162 at the top section of the dog base plate 161, and since one end of the dog base plate 161 is conjoined to an eccentric shaft 131 at the tail end of a lower drive shaft 13 of the bottom panel and the other end is conjoined to a rocker arm 164, when the lower drive shaft 13 of the bottom panel rotates, this initiates the movement of the dog base plate 161 and, furthermore, the material feed action of the press foot 17 at the upper extent of the material feed needle plate platform 16, and a revolving shuttle 18 connected to a drive mechanism 181 spins along with the rotating lower drive shaft 13, while facilitating the descension of the needle holder 121, such that the thread at the inner section of the revolving shuttle 18 and the needle 122 at the bottom end of the needle holder 122 is manipulated in a stitching routine that achieves the sewing of the object being processed D, wherein the emphasis is that the main drive shaft 11 of the said sewing machine 1 is disposed at a high position at the center section of the sewing machine 1 and, furthermore, the belts 14 and 15 are respectively utilized to drive the upper drive shaft 12 of the needle holder 121 and lower drive shaft 13 of the revolving shuttle 18, enabling the entire sewing machine 1 to have an appropriate height such that the material feed needle plate platform 16 below the needle 122 can be elevated, with the appearance of the overall structure shown in FIG. 8; additionally, extending upward from the top section of the dog base plate 161 is a vertical base plate 2 and, furthermore, a vertically oriented slot 21 is formed in the center section of the vertical base plate 2 and a horizontally oriented slot 22 is formed in bottom section of the vertical base plate 2, with a sliding block 211 and 221 situated in the vertically oriented and horizontally oriented slot 21 and 22, respectively, such that the vertical base plate 2 is capable of sliding upward and downward as well as swing forward and backward following the articulation of the sliding blocks 211 and 221 and slots 21 and 22; and, finally, the material feed dog 162 is installed at the top section of the said vertical base plate 2 and when the dog base plate 161 moves, the vertical base plate 2 moves along with it synchronously, thereby enabling the material feed dog 162 at the top section to complete a zigzag stitch as the material is being fed through.

Figure 6:
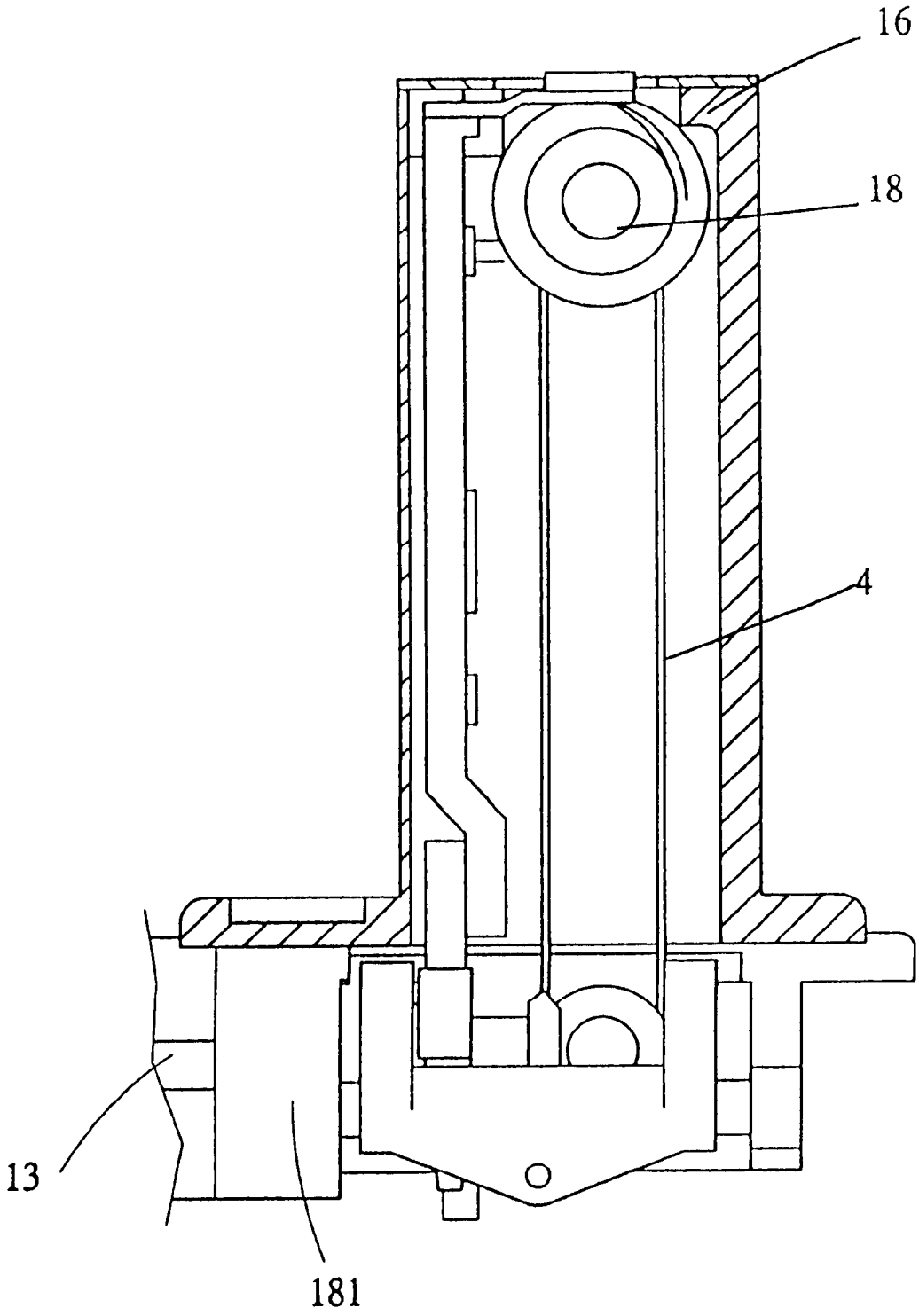
FIG. 6 is a cross-sectional drawing of another embodiment of the invention herein.

Additionally, in the interior section of the elevated material feed needle plate platform 16 (Post Bed) is a vertical drive shaft 3 linked to the drive mechanism 181 of the bottom panel that transports the revolving shuttle 18 close to the lower position of the elevated material feed needle plate platform 16 (Post Bed) and, furthermore, in synchronization with the rotating lower drive shaft 13, and the revolving shutter structure of the original level platform-type material feed needle plate base is extended into the interior section of the elevated material feed needle plate platform (Post Bed) 16 and, furthermore, as indicated in FIG. 6, a toothed belt 4 can be substituted to link the drive mechanism to the revolving shuttle drive shaft and similarly, the toothed belt 4 enables the revolving shuttle 18 to be driven synchronously with the lower drive shaft 13.

Figure 9:
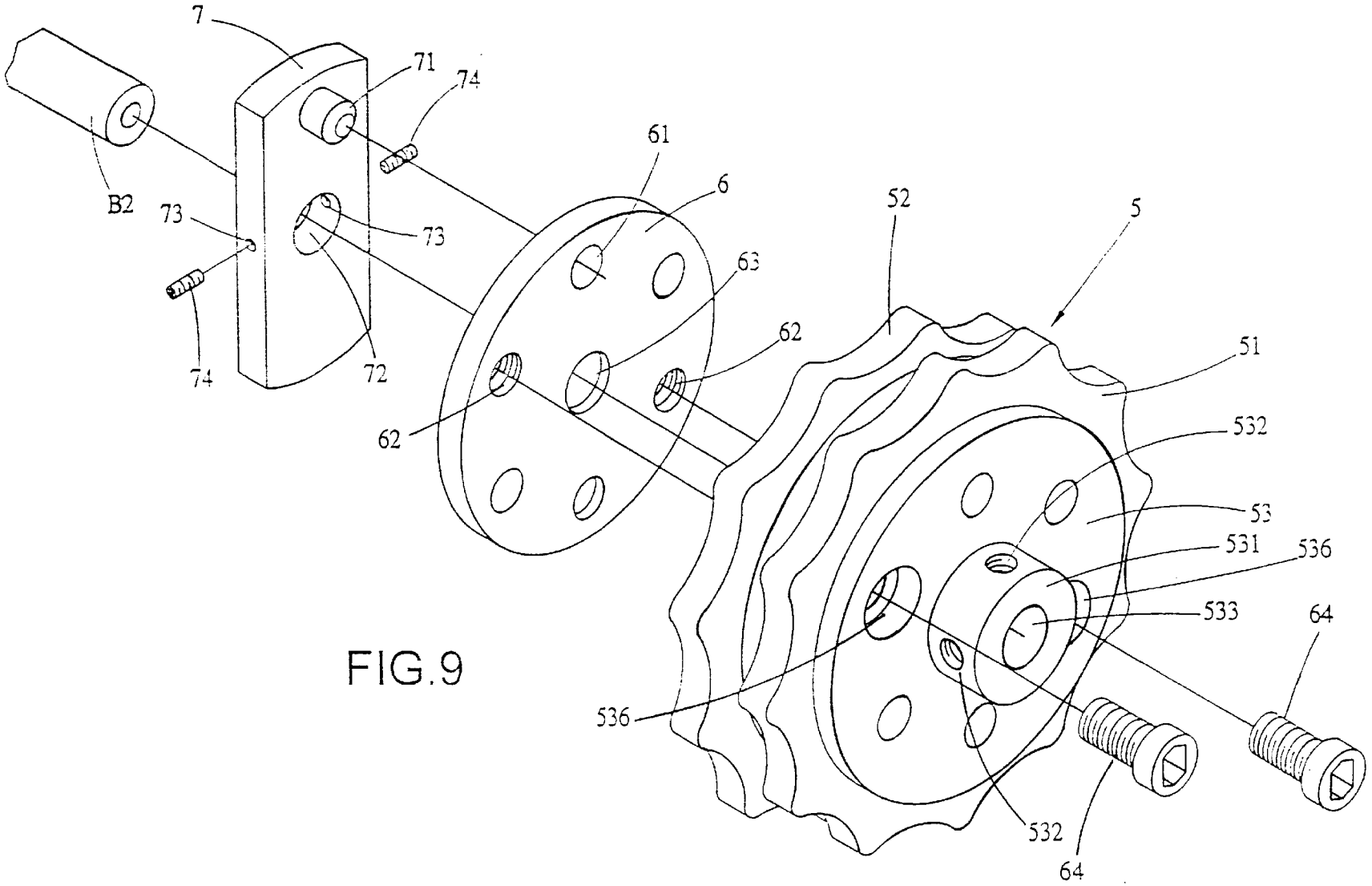
FIG. 9 is an exploded drawing of the pattern cam structure of the invention herein.
Figure 10:
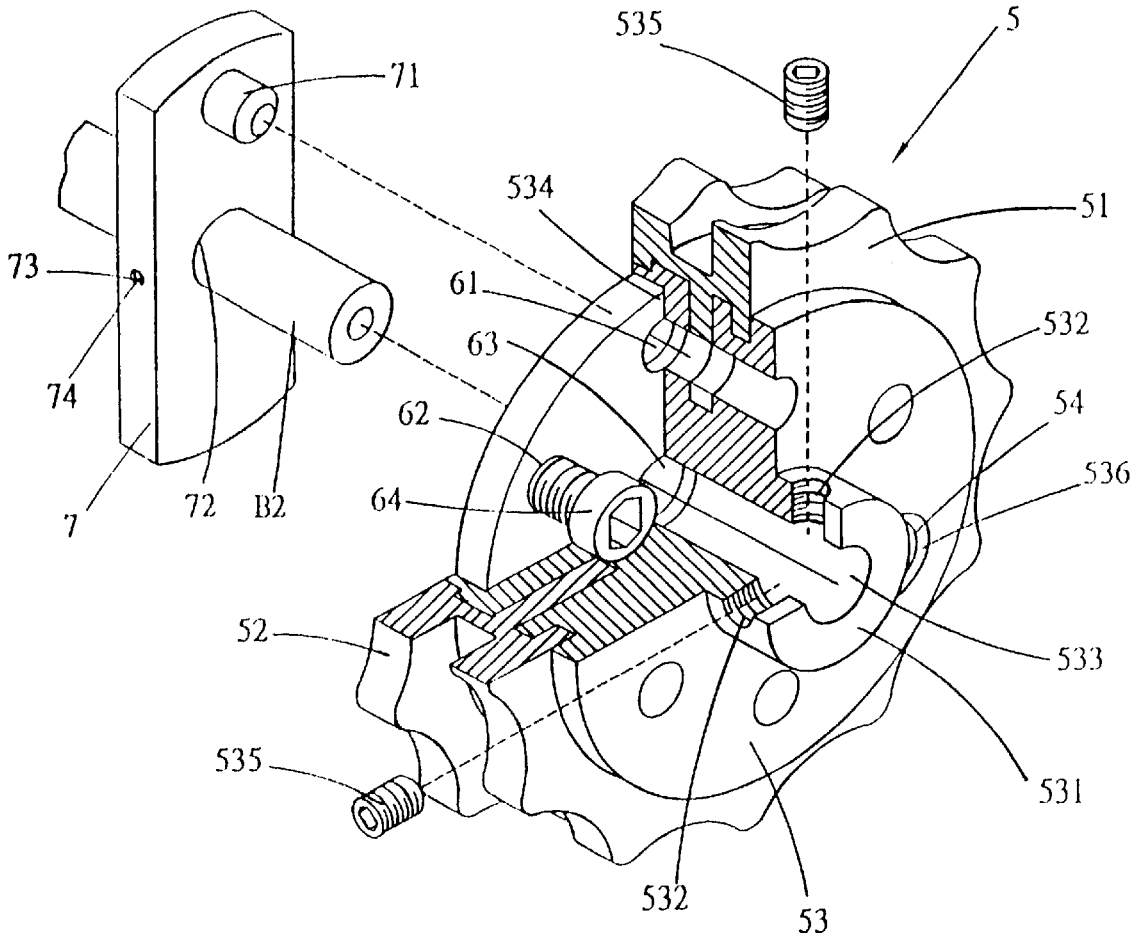
FIG. 10 is partial cross-sectional drawing of the pattern cam structure of the invention herein.

Furthermore, as indicated in FIG. 9 and FIG. 10, which depict another embodiment of the pattern cam structure of the invention herein, the front pattern plate element 51 and the rear pattern plate element 12 of the pattern cam 5 are directly attached to the pattern mounting base 13, with a shaft hole 533 at the center of the pattern mounting base 13 utilized for the insertion of a transverse shaft B2 having on its lateral end surface a coupling end 531 and, furthermore, a threaded holes 532 are tapped in the coupling end 531 so the pattern cam 5 can be fastened to the transverse shaft B2 by means of screws 535, and a skirt plate seating recess 534 is formed in the end surface of the pattern mounting base 13 where the pattern cam 5 is sleeved onto the transverse shaft B2 for the placement of a skirt plate 6 into the said skirt plate seating recess 534; the said skirt plate 6 has a shaft hole 63 formed at the center to provide for the insertion of the transverse shaft B2 and, furthermore, screws 64 are utilized to fasten the skirt plate 6 to the pattern mounting base 13 of the pattern cam 5; the said screws 64 are inserted into the fastener locating holes 536 formed in the other side of the pattern cam 5 pattern mounting base 13 and then tightened in the threaded holes 62 of the skirt plate 6, with the inner diameters of the fastener locating holes 536 being slightly larger than the outer diameters of the screws 64 to enable fine adjustments between the skirt plate 6 and the pattern cam 5.

In addition, the skirt plate 6 is assembled to a sighting block 7 that is first mounted on the transverse shaft B2, the sighting block 7 having a shaft hole 72 to provide for the insertion of the transverse shaft B2 and, furthermore, a threaded hole 73 tapped in its side to accommodate a screw 74 for fastening onto the transverse shaft B2 such that when the sewing machine is being assembled and set up, after the calibration of the pattern cam 5 and the eccentric idler wheel B31 is completed as well as the alignment of the locating pin 71 and the locating hole 61 between the sighting block 7 and the skirt plate 6, this provides for the rapid configuring of the pattern cam 5 and the transverse shaft B2 such that when the operating personnel replace the pattern cam 5 to change the sewing stitch pattern, they would only have to switch off the sewing machine and loosen the screws 535 fastening the pattern cam 5 to remove the transverse shaft B2 from the pattern cam 5, at which time since the sighting block 7 remains mounted on the transverse rod B2, when the new pattern cam 5 is installed, the skirt plate 6 of the new pattern cam 5 is fitted with the sighting block 7 still on the original transverse shaft B2 and thereby rapidly and, furthermore, accurately sleeve the pattern cam 5 onto the transverse shaft B5 and then refasten the pattern cam 5, which enables convenient pattern cam 5 replacement that can be performed by operating personnel onsite without seeking the assistance of technical personnel and thereby reduces the technical requirements of the operating personnel.

In summation of the foregoing section, since the invention herein is of an original and practical structure that not only is equipped with a columnar elevated material feed needle plate platform (post bed) capable of high-speed zigzag stitching and the enhanced sewing of objects being processed, but also increases the product quality and productivity by sewing machines in this category of industrial equipment by providing an elevated stitching platform sewing machine of a comparatively superior and feasible structure, the present invention is lawfully submitted in application for the granting of the commensurate new patent rights.

What is claimed is:

1. An improved structure for a high speed zigzag stitch industrial-use sewing machine including a pattern cam situated inside a head section controlling transverse motion of a needle holder and a material feed needle plate platform structure disposed at a bottom panel of the sewing machine, and situated in an interior section of the material feed needle plate platform is a dog base plate which facilitates installation of a material feed dog at a top section of the dog base plate, a first end of the dog base plate being conjoined to an eccentric shaft at a tail end of a lower drive shaft of the bottom panel and a second end being conjoined to a rocker arm, such that rotation of the lower drive shaft of the bottom panel initiates movement of the dog base plate and material feed action of a press foot at an upper extent of the material feed needle plate platform, and a revolving shuttle connected to a drive mechanism spins along with the rotating lower drive shaft, facilitating the descension of the needle holder, such that thread at the inner section of the revolving shuttle and a needle at the bottom end of the needle holder is manipulated in a stitching routine that achieves sewing of an object being processed, the structure comprising:

a main drive shaft of the sewing machine disposed at an upper position at a center section of the sewing machine; two belts respectively driving an upper drive shaft of the needle holder and the lower drive shaft of the revolving shuttle, enabling the entire sewing machine to have a height such that the material feed needle plate platform can be elevated under the needle; extending upwardly from the top section of the said dog base plate is a vertical base plate with a vertically oriented slot is formed in a center section of the vertical base plate and a horizontally oriented slot formed in a bottom section of the vertical base plate; a sliding block situated in each of the vertically oriented and horizontally oriented slots, respectively, such that the vertical base plate slides upward and downward as well as swinging transversely rightward and leftward following articulation of the sliding blocks and the slots; wherein the material feed dog is installed at the top section of the vertical base plate such that, when the said dog base plate moves, the vertical base plate moves along with it synchronously, thereby enabling the material feed dog at the top section to complete zigzag stitch as the material is being fed therethrough; and in an interior section of the elevated material feed needle plate platform is a vertical drive shaft linked to the drive mechanism of the bottom panel that transports the revolving shuttle close to a lower position of the elevated material feed needle plate platform in synchronization with the rotating lower drive shaft.

2. The zigzag sewing machine of claim 1 including a toothed belt linking the drive mechanism to the revolving shuttle drive shaft, whereby the toothed belt synchronously drives the revolving shuttle with the lower drive shaft.

3. The zigzag sewing machine of claim 1 including a skirt plate seating recess formed in an end surface of a pattern mounting base; a pattern cam sleeved onto a transverse shaft for placement of a skirt plate into the skirt plate seating recess wherein screws are utilized to fasten the skirt plate the screws being inserted into fastener locating holes formed in the pattern cam pattern mounting base and the threaded holes of the skirt plate, inner diameters of the fastener locating holes being larger than outer diameters of the screws to enable fine adjustments between the skirt plate and the pattern cam; the skirt plate being assembled to a sighting block mounted on a transverse shaft, the sighting block having a shaft hole accommodating the transverse shaft and a threaded hole in a side receiving a screw fastening onto the transverse shaft such that, after calibration of the pattern cam and an eccentric idler wheel is completed, a locating pin is aligned with a locating hole between the sighting block and the skirt plate.

* * * * *